United States Patent [19]

Lambach

[11] Patent Number: 4,501,364

[45] Date of Patent: Feb. 26, 1985

[54] FOLDING BOX

[75] Inventor: Heinrich W. Lambach, Horsens, Denmark

[73] Assignee: Brdr. Schur International A/S, Horsens, Denmark

[21] Appl. No.: 297,694

[22] PCT Filed: Mar. 12, 1979

[86] PCT No.: PCT/DK79/00007

§ 371 Date: Nov. 13, 1979

§ 102(e) Date: Nov. 13, 1979

[87] PCT Pub. No.: WO79/00740

PCT Pub. Date: Oct. 4, 1979

[30] Foreign Application Priority Data

Mar. 10, 1978 [GB] United Kingdom ..... 9601/78

[51] Int. Cl.[3] ..... B65D 5/70

[52] U.S. Cl. ..... 206/626; 206/628

[58] Field of Search ..... 206/620, 626, 611, 628; 229/17 R

[56] References Cited

U.S. PATENT DOCUMENTS

| | | | |
|---|---|---|---|
| 637,397 | 11/1899 | Lynch | 206/626 |
| 2,294,964 | 9/1942 | Davidson | 229/17 R |
| 2,358,923 | 9/1944 | Guyer | 229/17 R |
| 2,364,439 | 12/1944 | Guyer | 229/17 R |
| 2,367,706 | 1/1945 | Williamson | 206/628 |
| 3,097,785 | 7/1963 | Meyers | 206/628 |
| 3,251,530 | 5/1966 | Hodgkins | 229/17 R |
| 3,570,745 | 3/1971 | Fuse-shi | 229/17 R |
| 3,606,135 | 9/1971 | Rosenburg, Jr. | 206/628 |

*Primary Examiner*—Stephen P. Garbe

*Attorney, Agent, or Firm*—Antonelli, Terry & Wands

[57] ABSTRACT

A folding box of the type having an openable end flap, the outer end of which is provided with a free folding flap which, when the end flap is closed, is put down along the inside of the box front panel opposite to the rear panel, to which the end flap is hinged, the closed box being provided with a cover portion located at the outside of the said end flap and connected with opposed edge portions of the box opening normally closed by the end flap, such that the cover portion prevents opening of the end flap, said cover portion being connected with at least one of the said edge portions across a rupture line whereby, when said rupture line is broken or the cover portion is entirely torn off, the end flap is freely openable.

4 Claims, 8 Drawing Figures

FOLDING BOX

This invention relates to folding boxes, e.g. pellet cartons, of the common type having an openable end flap, the outer end of which is provided with a free holding flap which, when the end flap is closed, is put down along the inside of the box front panel opposite the rear panel, to which the end flap is hinged. This carton type is very popular, because it is easy to produce at low costs and easy to handle by opening and reclosing, the said holding flap serving to stabilize the end flap in its closed position in a reasonably good manner. However, since the carton is very easy to open it is often desired to provide the cartons with some kind of a breakable guarantee seal, but so far no practical seal means formed integrally with the carton have been proposed, and the most common solution has been to pack the filled and closed carton in a sheet wrapping which is closed about the carton and normally provided with a seizable rupture strip.

It is the purpose of the invention to provide a carton of the said type, in which a guarantee seal means is provided in an advantageous manner as an integral portion of the carton blank.

According to the invention this is acheived by the carton being designed with a cover portion the end flap of which will be openable only after a breaking up, wholly or partly, of the cover portion, such that this will constitute a guarantee seal, which, however, will not prevent quite normal use of the carton once it has been broken the first time the carton is opened.

The invention also comprises such carton blanks which are designed in such a manner that upon the erection and closing thereof they appear as cartons having the said cover portion constituting a guarantee closure for the openable end flap.

Figure 1:
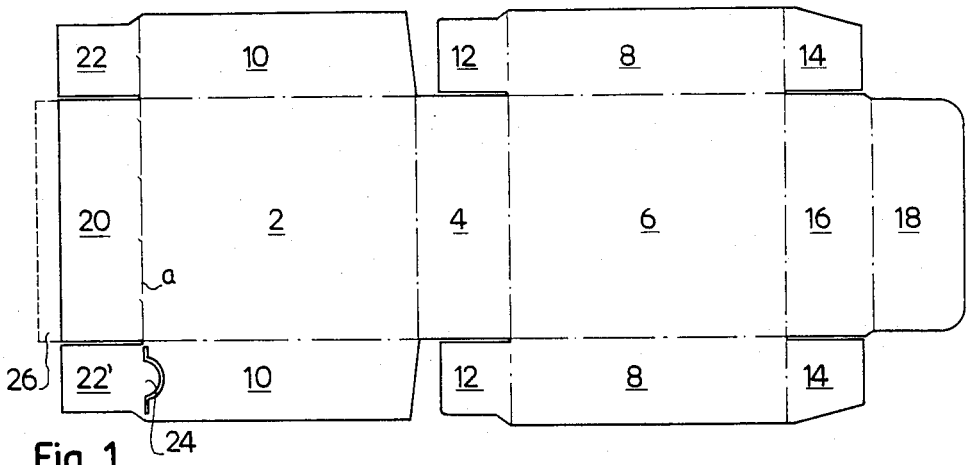
Figure 2:
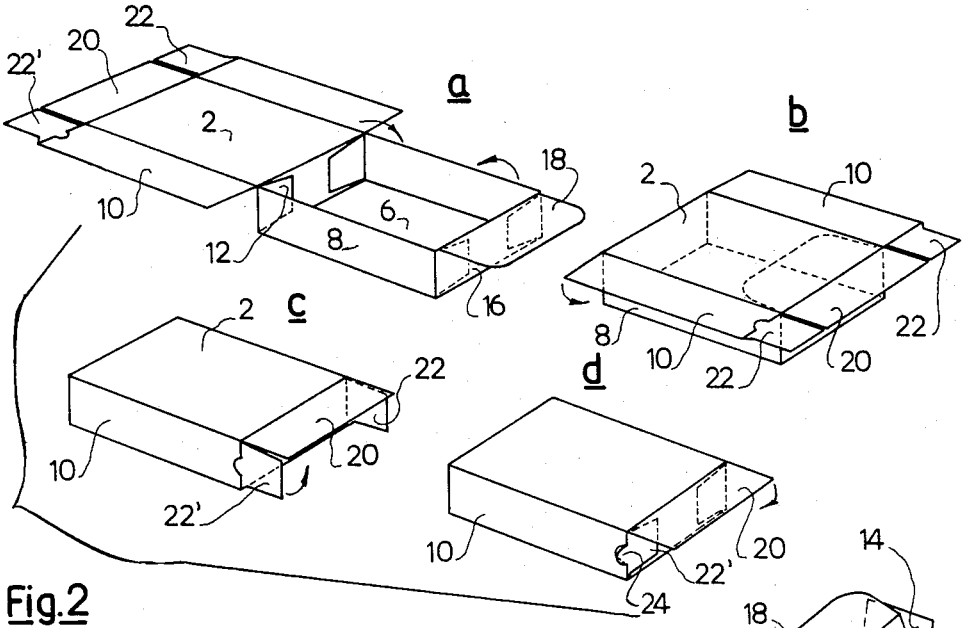
Figure 3:
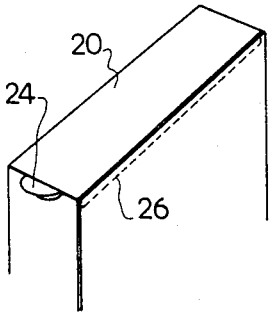
Figure 4:
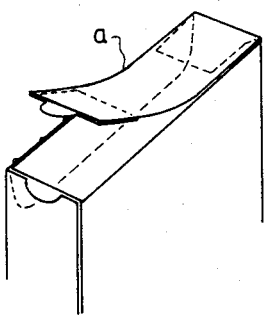
Figure 5:
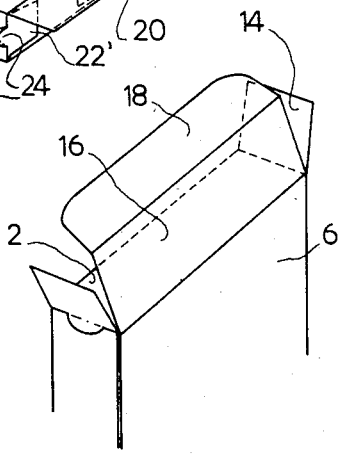

The invention is described in more detail in the following with reference to the accompanying drawings, in which:

FIG. 1 is a plan view of a blank for a carton according to a preferred embodiment of the invention, FIG. 2 is a perspective side view of the carton in four stages of partial erection, and FIGS. 3–5 are perspective topviews of the carton illustrating the manner of opening of the carton.

The blank shown in FIG. 1 is basically of well known design inasfar as it includes a front panel 2, a bottom panel 4, a rear panel 6, opposed inner side panels 8, opposed outer side panels 10, bottom corner flaps 12, top corner flaps 14 connected with the inner panels 8, a top end flap 16 hinged to the top (outer) end of the rear panel 6, and a holding flap 18 forming an extension of the top end flap 16. Briefly, the blank is erectable into a well known box shape as illustrated in FIG. 5, which shows the carton top in opened condition. However, according to the present invention the front panel 2 is extended into a second top flap 20, and the outer side panels 10 are correspondingly extended into secondary top corners flaps 22 and 22', respectively. Generally, the latter portions 20, 22 and 22' are joined to the respective panels 2 and 10 across a precut weakening or tear up line a, and the corner flap 22' has a half circular tap portion 24 generally cut out in the material of the adjoining side panel 10, at the other side of the line a.

FIG. 2*a* shows an intermediate erection position of the box member in which the rear panel 6 forms the bottom in an open box structure ready to receive the material to be filled into the carton, the box end walls being stabilized in their vertical positions by outer support means of the filling machine (not shown), whereafter the "lid" structure shown in the left hand side of FIG. 2*a* is folded over the filled box, when the holding flap portion 18 has been folded inwardly as shown in dotted lines in FIG. 2*b*. Thereafter the panels 10 are folded down and secured to the outsides of the panels 8, by glueing, welding or otherwise, FIG. 2*c*. The corner flaps 22, 22' are folded down at the same time, and thereafter they are separately folded inwardly without being secured to the outside of the end flap 16 (FIG. 2*d*). Finally the flap 20 is folded down and secured to the outside of the corner flaps 22, 22', while not being secured to the surface of the end flap 16 which may remain exposed between the ends of the opposed corner flaps 22, 22'. The detailed manner in which the box is erected should need no further description here.

By the folding in of the secondary corner flap 22' the tab 24 will be brought to project from the regular box structure as shown in FIGS. 2 and 3, the latter illustrating the final shape of the top end of the carton in its final shape.

In order to open the carton it is now necessary—and possible—to lift the tab 24 and pull off the entire top panel 20, as illustrated in FIG. 4. The first result of the lifting of the tap 24 is that the weakening line a between the corner flap portion 22' (as rigidly joined to the cover flap or top panel 20) and the adjoining outer side panel 10 will be broken, whereby the flap 22' is freely liftable, and by the further lifting the top panel 20 will be torn up along the side line a, it being entirely free along its opposite side edge. By the end of the lifting of the panel 20 also the corner flap 22 will be torn off along the line a, since it is joined to the panel 20, and consequently the entire strip shaped assembly 20, 22, 22' will be completely torn off.

Thereafter the user will have free access to the "ordinary" end flap portion 16, and he or she may now open and reclose the carton (FIG. 5) in a fully conventional manner.

It will be appreciated, however, that before tearing off the said strip 20, 22, 22' there will be no possibility to open the carton, so this structure, which is an integral portion of the carton blank, will constitute the desired guarantee seal.

Of course the invention is not limited to the embodiment shown in the drawing. Thus, instead of the front and rear panels 2 and 6 being hinged to each other through the bottom panel 4 they may be "side hinged" through one of the side panels, and the "guarantee" top strip 20 may be constituted by a prolongation of one or both of the corner flaps 22 or 22', i.e. without this strip being connected with the panel 2 at all. On the other hand the strip 20 would not need to be joined to any corner flaps 22 if it is provided with a projection 26 as shown in dotted lines in FIGS. 1 and 3, when such a projection is caused to be secured, by glueing, welding or otherwise, to the top edge area of the rear panel 6 and is connected with the end strip 20 through a breakable weakening line.

Obviously, the desired guarantee sealing will be obtained whenever the cover flap member 20 extends between two opposed edge portions of the top opening of the carton, but it should be observed that a corresponding effect is obtainable if the member 20 is made e.g. as a triangular member joined to the edges of the opening along two orthogonal edge portions only.

Moreover, the invention is of course not limited to a carton member which is erected and filled exactly as described, since it will be clear to any expert that the final and desired result is not depending of the detailed manner of erecting the carton.

In a preferred embodiment both sides of the carton blank are coated by a layer of artificial material, whereby the joints between the panels and the corner flaps may be heat actuated in a very simple manner, and when even the inside of the carton is thus coated, it will no longer be necessary to make use of a separate internal sheet lining as otherwise conventionally used in pellet cartons.

I claim:

1. A blank for erecting a reclosable box of the type having an openable end flap hinged at one edge to a rear panel of the box and provided at an opposite edge with a free holding flap which, when the end flap is closed, is tucked inside a front panel of the box and in which opposed side panels of the box are provided with flap extensions folded inwardly as inner corner flaps disposed inside the end flap, the box further comprising a pair of outer side panels, each of which overlies and is secured to a respective one of said opposed side panels and has a respective flap extension which is folded in along a fold line over end flap to form an additional corner flap, and a cover flap forming an extension of the front panel and folded over along a fold line to overlie the additional corner flaps and the end flap, and wherein the cover flap is secured to the additional corner flaps, and the cover flap and the additional corner flaps are removable together by rupturing the said fold lines to expose the end flap and permit its being opened, and in which the side panels are narrower than the front and rear panels, and wherein the front and rear panels are folded up from opposite edges of a bottom panel opposite the end flap and are each provided along opposite edges with extension which in the erected box constitute the said opposed side panels and the said outer side panels, said blank comprising panel portions defining the bottom panel, front panel, rear panel, opposed side panels, corner flaps on the side panels and end flap on the rear panel, as well as the cover flap on the front panel, for said box, and wherein the front and rear panels are connected with opposed edges of the bottom panel, and side panels are provided at both sides of the rear panel and front panel, respectively, these side panels each having a corner flap projecting from adjacent ends thereof, the corner flaps of the side panels belonging to the front panel being connected with those side panels through lines of weakness constituting prolongations of a line of weakness between the front panel and the cover flap.

2. A reclosable box of the type having an openable end flap hinged at one edge to a rear panel of the box and provided at an opposite edge with a free holding flap which, when the end flap is closed, is tucked inside a front panel of the box and in which opposed side panels of the box provided with flap extensions folded inwardly as inner corner flaps disposed inside the end flap, the box further comprising a pair of outer side panels, each of which overlies and is secured to a respective one of said opposed side panels and has a respective flap extension which is folded in along a fold line over the end flap to form an additional corner flap, and a cover flap forming an extension of the front panel and folded over along a fold line to overlie the additional corner flaps and the end flap, and wherein the cover flap is secured to the additional corner flaps, and the cover flap and the additional corner flaps are removable together by rupturing the said fold lines to expose the end flap and permit its being opened.

3. A box according to claim 2, erected from a unitary blank and in which the side panels are narrower than the front and rear panels, and wherein the front and rear panels are folded up from opposite edges of a bottom panel opposite the end flap and are each provided along opposite edges with extentions which in the erected box constitute the said opposed side panels and the said outer side panels.

4. A box according to claim 2 or 3 and having a tab projecting from an edge of the cover flap, the tab being formed as a cut portion of one of the outer side panels adjacent the corner line between this panel and its associated additional corner flap, whereby in the erected and closed box the tab projects outwardly from said corner line in the plane of the additional corner flap.

* * * * *